US006249968B1

(12) United States Patent
Young

(10) Patent No.: US 6,249,968 B1
(45) Date of Patent: Jun. 26, 2001

(54) METHOD OF MAKING A ROBUST GOSPER FIN HEAT EXCHANGER

(75) Inventor: Darryl Leigh Young, Belleville, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/382,754

(22) Filed: Aug. 25, 1999

(51) Int. Cl.[7] ..... B21D 53/06

(52) U.S. Cl. ..... 29/890.047; 29/890.043; 29/890.054

(58) Field of Search ..... 29/890.043, 890.044, 29/890.054, 890.047, 726, 727; 72/370.13

(56) References Cited

U.S. PATENT DOCUMENTS

| | | | | |
|---|---|---|---|---|
| 3,972,219 | | 8/1976 | Riehl | 72/214 |
| 4,692,979 | | 9/1987 | Pietzcker | 29/157.3 C |
| 4,730,669 | | 3/1988 | Beasley et al. | 165/151 |
| 4,930,331 | | 6/1990 | Manning | 72/396 |
| 5,014,422 | * | 5/1991 | Wallis | 29/890.044 |
| 5,165,153 | * | 11/1992 | Young et al. | 29/33.6 |
| 5,186,239 | * | 2/1993 | Young et al. | 165/81 |
| 5,257,454 | * | 11/1993 | Young et al. | 29/890.043 |
| 5,318,111 | * | 6/1994 | Young et al. | 165/150 |
| 5,390,733 | * | 2/1995 | Young | 165/173 |
| 5,457,885 | * | 10/1995 | Ohashi et al. | 29/890.044 |
| 5,501,270 | | 3/1996 | Young et al. | 165/151 |
| 5,526,670 | | 6/1996 | Parola | 72/416 |
| 5,604,982 | * | 2/1997 | Kent et al. | 29/890.044 |
| 5,752,313 | * | 5/1998 | Gaffaney et al. | 29/727 |
| 6,138,747 | * | 10/2000 | Kroger et al. | 29/890.044 |

FOREIGN PATENT DOCUMENTS

| | | |
|---|---|---|
| 33 27 335 | 2/1985 | (DE) . |
| 436 964 | 11/1911 | (FR) . |
| 2567 247 | 1/1986 | (FR) . |
| 127 107 | 5/1919 | (GB) . |
| 964422 | 10/1982 | (SU) . |

* cited by examiner

*Primary Examiner*—I Cuda Rosenbaum
(74) *Attorney, Agent, or Firm*—Larry I. Shelton

(57) ABSTRACT

A method of making a heat exchanger core (56) having a stack of fins (60) having collared holes through which tubes (30) are laced. An overlying fin is supported on an underlying fin by collars (90) around the holes in one of the fins. Leading lengthwise end portions (66) of the tubes are corrugated and each tube is laced, via its leading lengthwise end portion, through a respective set of aligned holes in the fins. Then the tubes are mechanically staked to at least some of the fins in the stack by expanding the cross sections of the corrugated leading lengthwise end portions of the tubes against the collared holes in those fins through which the corrugated leading end portions pass (FIGS. 14–18).

16 Claims, 6 Drawing Sheets

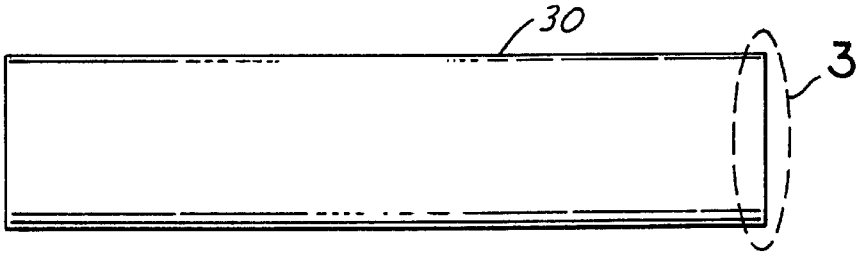
(PRIOR ART) FIG. 1
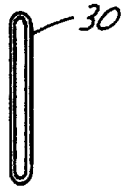
(PRIOR ART) FIG. 2
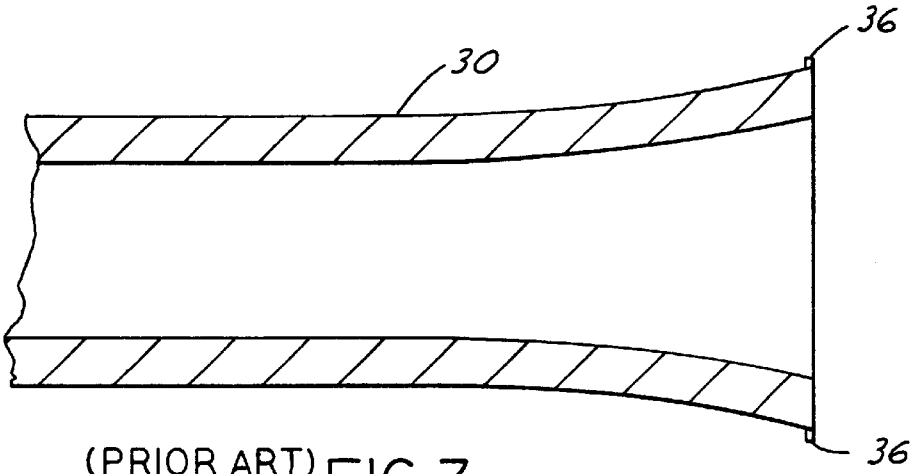
(PRIOR ART) FIG. 3
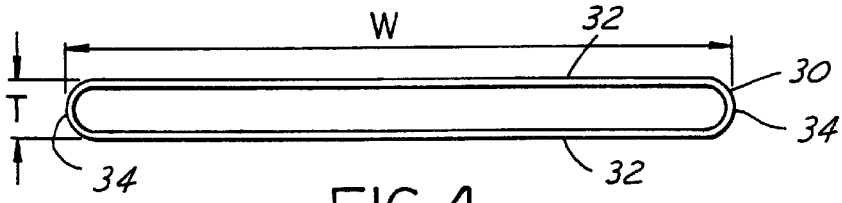
FIG. 4
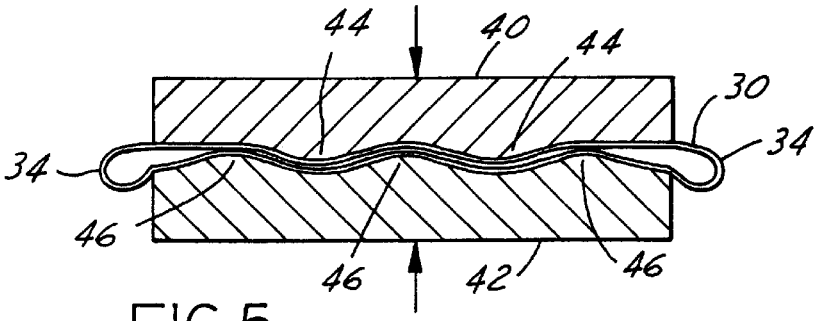
FIG. 5

METHOD OF MAKING A ROBUST GOSPER FIN HEAT EXCHANGER

REFERENCE TO A RELATED APPLICATION

Certain subject matter that is disclosed in the present application is also the subject of the commonly owned patent application of the same inventor, METHOD OF MANUFACTURING A FLAT CORRUGATED TUBE, Ser. No. 09/382,755, filed Aug. 25, 1999, now U.S. Pat. No. 6,151,949 issued Nov. 28, 2000.

BACKGROUND OF THE INVENTION

1. Field of the Invention

This invention relates generally to heat exchange structures, and is particularly concerned with improvements in heat exchangers of the type disclosed in U.S. Pat. No. 5,501,270 issued Mar. 26, 1996 in the names of the present inventor and Barry W. Blumel.

2. Background Information

U.S. Pat. No. 5,501,270 shows a heat exchange structure that comprises a stack of metal fins laced together by parallel tubes. Consecutive fins are substantially uniformly spaced from each other throughout the stack. The fins comprise identical patterns of collared holes through which the tubes lace the stack. The tubes have oval transverse cross sections. In plan view, the fin holes have oval shapes just slightly larger than the oval cross sections of the tubes. The fins and tubes are brazed together around each hole through which a tube passes.

When the heat exchanger is in use, a first heat exchange fluid flows through the parallel tubes, and a second heat exchange fluid flows through the stack from a front face of the stack to a rear face of the stack. The second heat exchange fluid enters the front face from a direction that is generally perpendicular to the tubes.

Within the interior of the stack, a major portion of the area of each fin lies in a respective plane that is non-perpendicular to the direction from which the second fluid approaches it. In general, those interior portions of the fins are disposed in planes that are non-perpendicular to the direction from which the second fluid approaches the front face of the stack.

In addition to the collared holes, the interior portions of the fins contain rows of louvered slots arranged to cause the second fluid to flow through the slots as it passes through the stack. The novel core constructions disclosed in the referenced patent are efficient in respect of both heat exchange and fluid pressure drop.

SUMMARY OF THE INVENTION

In a general respect, the present invention relates to improvements in fabricating heat exchanger cores, especially cores that comprise tubes having generally flat, oblong cross sections, for facilitating the lacing of tubes through fins stacks and for mechanically staking the tubes to the fins prior to metallurgical bonding of the tubes to the fins.

A general aspect of the within claimed invention relates to a method of making a heat exchanger core that comprises a stack of fins having sets of aligned holes through which tubes are laced, the method comprising: corrugating at least portions of the lengths of the tubes; lacing each tube through a respective set of aligned holes in the fins; and then expanding the cross sections of the corrugated portions of the tubes.

Another general aspect of the within claimed invention relates to a method of making a heat exchanger core that comprises a stack of fins having sets of aligned oval holes through which tubes of oval cross section are laced, wherein the oval cross section of the tube comprises nominal width and thickness having substantially flat, substantially parallel, sides that are spaced apart in the direction of the nominal thickness and that are joined by rounded ends in the direction of nominal width, the method comprising: corrugating the substantially flat, substantially parallel, sides of the tubes along at least portions of the lengths of the tubes and lacing each tube through a respective set of aligned holes in the fins; and then expanding the cross sections of the tubes containing the corrugated sides.

Still another general aspect of the within claimed invention relates to a method of making a heat exchanger core that comprises a stack of fins having at least one set of aligned holes through which a respective nominally oval tube is laced, the method comprising: for each set of aligned holes, providing a respective tube that has an oval cross section of nominal width and thickness and a corrugated lengthwise leading end portion that has a transverse cross section of overall width and thickness slightly less than the nominal width and thickness of the oval cross section; and lacing each tube through the respective set of holes by inserting the leading lengthwise end portion into a first hole of the respective set that is in a first of the fins in the stack and then through successive holes of the respective set that are in successive fins in the stack.

Still another general aspect of the within claimed invention relates to a method of making a heat exchanger core that comprises a stack of fins having at least one set of aligned holes through which a respective nominally oval tube is laced, the method comprising: for each set of aligned holes, providing a respective tube that comprises an oval cross section of nominal width and thickness having substantially flat, substantially parallel, sides that are spaced apart in the direction of the nominal thickness and that are joined by rounded ends in the direction of nominal width and that comprises a lengthwise leading end portion that comprises a transverse cross section of overall width and thickness slightly less than the nominal width and thickness of the oval cross section and that comprises corrugated sides continuing lengthwise of the tube from the substantially flat, substantially parallel, sides of the oval cross section of nominal width and thickness; and lacing each tube through the respective set of holes by inserting the corrugated leading lengthwise end portion into a first hole of the respective set that is in a first of the fins in the stack and then through successive holes of the respective set that are in successive fins in the stack.

The invention also relates to heat exchanger cores made by these methods.

Other general and more specific aspects will been set forth in the ensuing description and claims.

BRIEF DESCRIPTION OF THE DRAWINGS

The drawings that will now be briefly described are incorporated herein to illustrate a preferred embodiment of the invention and a best mode presently contemplated for carrying out the invention.

FIG. 1 is a plan view of a known tube used in certain heat exchangers.

FIG. 2 is a right side view of FIG. 1.

FIG. 3 is an enlarged and exaggerated view, in section, in circle 3 of FIG. 1.

FIG. 4 is an end view of a tube that is about to be processed in accordance with the present invention.

FIG. 5 is an end view of the tube of FIG. 4 during a step in the process.

DESCRIPTION OF THE PREFERRED EMBODIMENT

FIGS. 1–3 illustrate an end of a tube 30 that has heretofore been used in the manufacture of core structures of heat exchangers like those shown in the referenced patent. Such core structures contains a number of such tubes that are have been laced through aligned holes in the fin stack and joined to the individual fins in the stack. The act of cutting a length of tube from tube stock may create a condition at the tube end which distorts the nominal cross section. The nominal cross section comprises an elongate oval having a width W and a thickness T. Generally parallel, longer sides 32 are joined at opposite ends by much shorter sides 34 which are essentially semi-circularly curved. The distortion is shown by the exaggerated view of FIG. 3 where it can be seen that the shorter sides 34 bulge outward to impart a somewhat bellmouthed shape to the tube end in the direction of the long dimension of the tube cross section. Small burrs 36 may also be present after the cutting.

Because of this distortion of the tube end, there may be a problem with lacing the tubes through the holes in the fin stack. If a hole is too small, a tube may not pass freely through the stack as it is being laced. The tube end may instead catch, snag, or hang up, on the edge of a fin hole before complete insertion through the stack. On the other hand, if the holes in the stack are sized sufficiently large to avoid that problem, it becomes more difficult to place the tubes in thermally conductive relationship with the fins because there is larger clearance between the nominal cross section of a tube and the fin holes through which it is laced.

Figure 6:
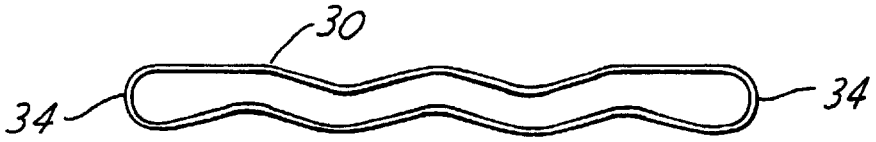
FIG. 6 shows the shape that the tube end would tend to assume if it were not processed further.
Figure 7:
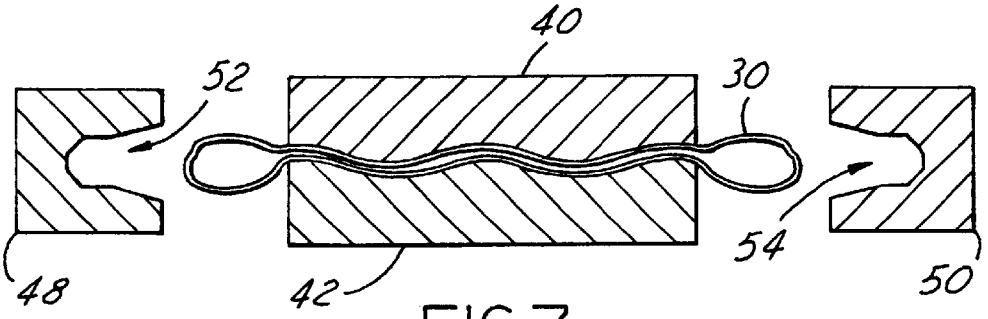
FIG. 7 is an end view of the tube during another step in the process.
Figure 8:
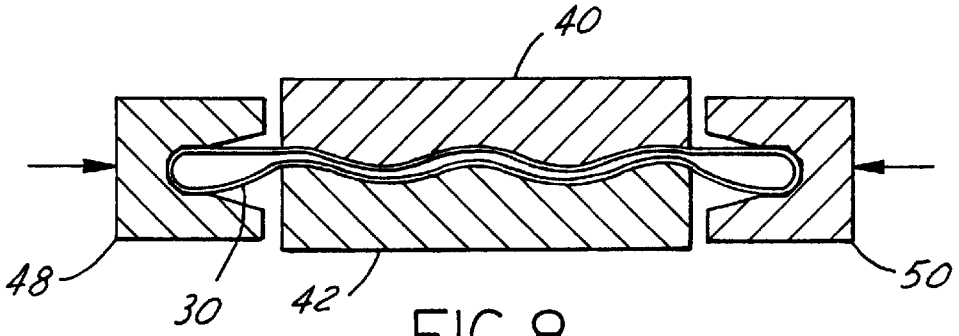
FIG. 8 is an end view of the tube during a further step in the process.

FIGS. 5–10 disclose a series of steps for processing a tube end 30 like that in FIGS. 1–3 in order to avoid both of the aforementioned problems. FIG. 4 shows an initial shape for tube 30 like that described above. The distortion that has been described is not apparent in FIG. 4 due to the scale of the Figure, but it is present. In order to eliminate the effects of the bellmouth and of any burrs 36 on the lacing process, the end portion of tube 30 is squeezed in the direction of the cross section thickness between opposing metal dies 40, 42 in a suitable machine, such as a press. Only an intermediate portion of the tube cross section however is squeezed, leaving the shorter rounded ends of the cross section free. Confronting faces of dies 40, 42 that squeeze the tube comprise matching corrugations 44, 46 that act on the widthwise intermediate portion of the tube end to corrugate that portion. The corrugations may be considered to have a somewhat sinusoidal shape, as shown. The tube is squeezed to an extent that forces the opposite sides 32 against each other. If the dies were to be retracted, sides 32, although now corrugated, would exhibit some degree of springback that would separate them, as shown by FIG. 6. However, instead of being retracted, the dies continue to hold the sides 32 against each other as in FIGS. 7 and 8 while a further operation that reforms the widthwise end portions 34 of the tube cross section is performed.

Figure 9:
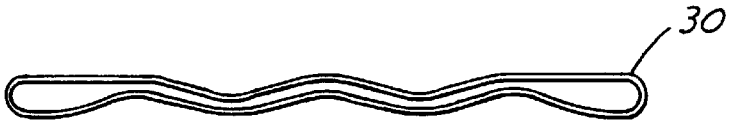
FIG. 9 is an end view of the tube after the step of FIG. 8, as taken in the direction of arrows 9—9 in FIG. 10.
Figure 10:
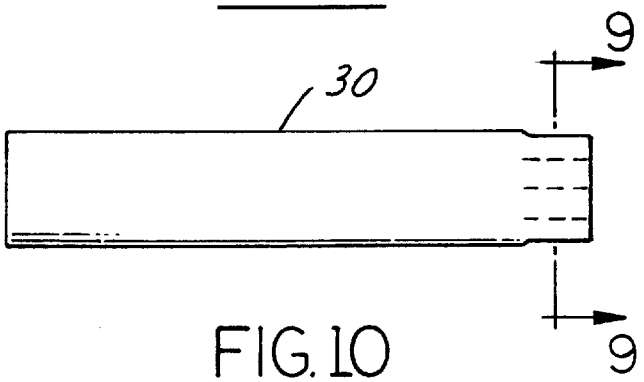
FIG. 10 is a plan view of the tube after the step of FIG. 8.

That operation comprises forcing respective dies 48, 50 over the respective widthwise end portions of the tube cross section that protrude from the sides of the closed dies 40, 42. Each die 48, 50 comprises a respective cavity 52, 54 that engages the respective protruding widthwise portion of the tube, and that has a shape for reducing the extent to which the respective portion protrudes from the closed dies 40, 42 in the direction of the tube width W, and for coining any burrs 36 that may be present. Dies 40, 42 can coin any burrs that are in the corrugated portion. Moreover, the cavity shapes, and the extent to which the protrusions are shortened in the direction W, are chosen such that when dies 48, 50 are retracted, followed by retraction of dies 40, 42, the cross section of the tube end will have an overall width and thickness that do not exceed the nominal width W and nominal thickness T. It is especially desired that the final shape, as shown by FIGS. 9 and 10, have a width that is less than the nominal width and a thickness less than the nominal thickness. In other words, after all dies have been retracted, the tube end has been sized to a desired overall final width and a desired overall final thickness, free of substantial springback. Although the foregoing has described processing only an end portion of a tube, it should be understood that a tube may be processed up to as much as its full length in the manner described.

Figure 11:
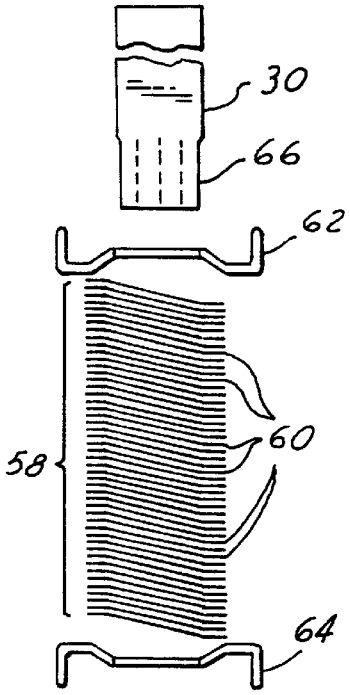
FIGS. 11–18 is a sequence of related steps subsequent to the step of FIG. 10.

FIGS. 11–18 disclose a series of steps in fabricating a heat exchanger core utilizing tubes that have been processed in the manner of FIGS. 4–10. The finished heat exchanger core 56, and certain of its details, are shown in FIGS. 19–22. FIG. 11 shows a stack 58 of individual heat exchanger fins 60 sandwiched between header plates 62, 64. Fins 60 are identical, each having a matching hole pattern comprising individual collared holes each of which is adapted to be laced by a tube 30. When fins 60 are arranged in registration to form stack 58, each hole of an overlying or underlying fin assumes registration with a corresponding hole of an underlying or overlying fin. A uniform spacing distance between consecutive fins in the stack is maintained by abutment of one fin with the collars that surround each hole of a consecutive fin.

Figure 12:
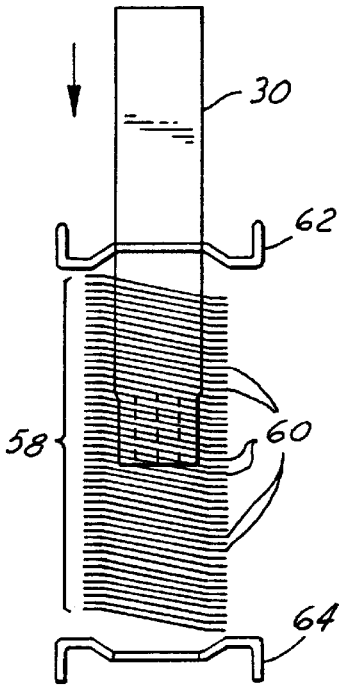
Figure 13:
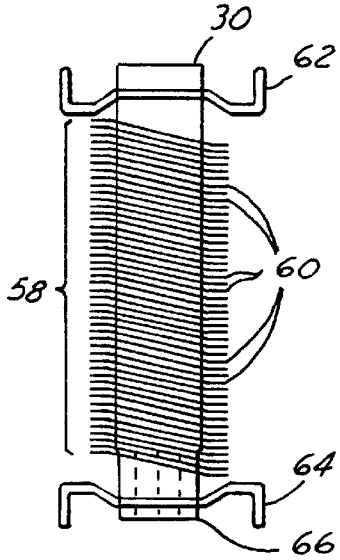

The leading end 66 of tube 30 has been processed according to FIGS. 4–10 and has clearance to the holes in the fins through which it passes when laced into stack 58. Clearance holes are also present in header plates 62, 64. FIG. 11 shows the relative positions of parts prior to lacing tube 30 through stack 58. As the lacing begins, tube is inserted through a hole in header plate 62 into stack 58, leading end 66 first. FIG. 12 shows the lacing partially complete. FIG. 13 shows the completed lacing where tube 30 has passed completely through the stack, including passing through holes in header plates 62, 64.

Figure 14:
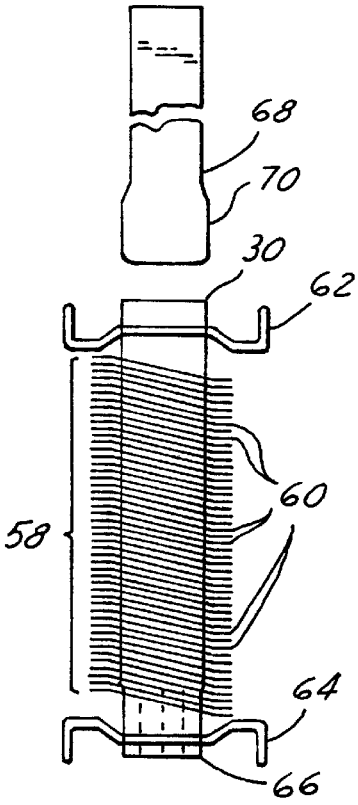
Figure 15:
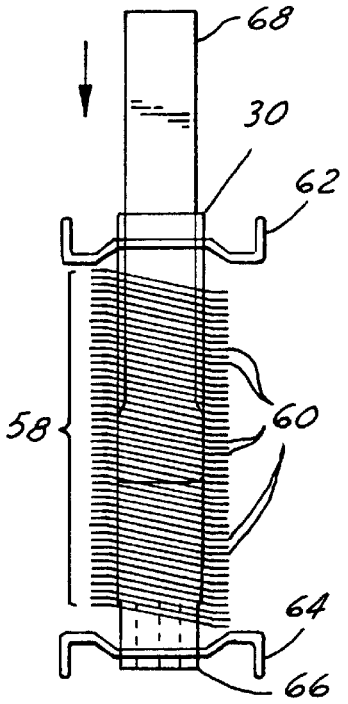
Figure 16:
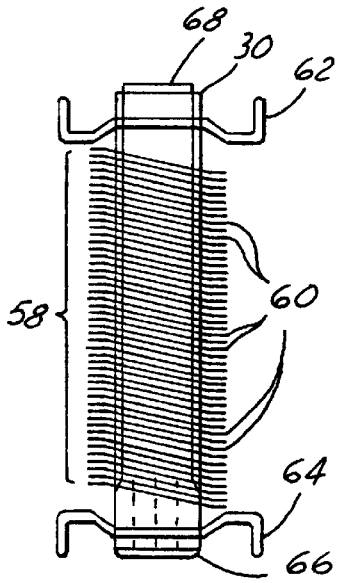
Figure 17:
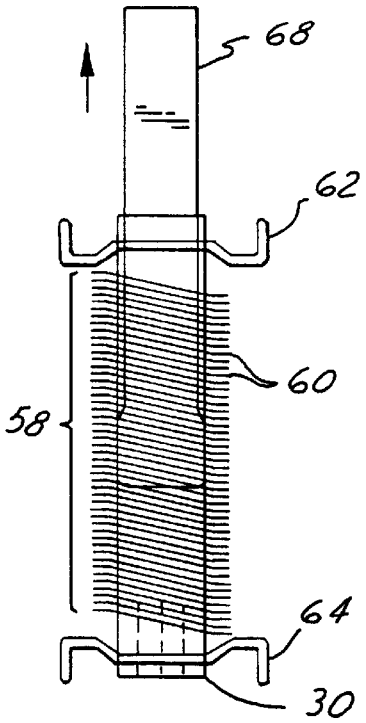
Figure 18:
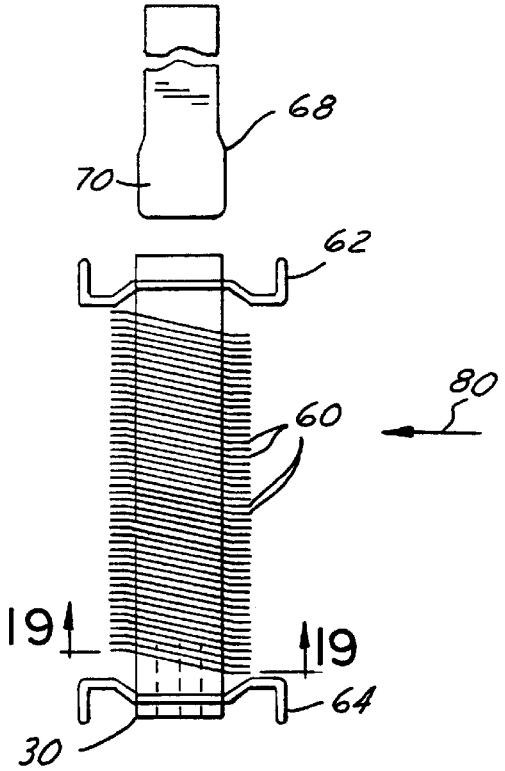

Next a mandrel 68 is introduced into the interior of tube at the end opposite the end that was processed in accordance with FIGS. 4–10. The mandrel is then advanced through the tube. FIG. 14 shows relative positions of parts prior to mandrel insertion, FIG. 15 shows relative positions at an intermediate stage where mandrel 68 has been inserted and partially advanced, and FIG. 16 shows relative positions after full advancement of mandrel 68. The distal end 70 of mandrel 68 has a cross section that is enlarged from that of the remainder that enters the tube. That enlarged distal end has a transverse cross sectional shape that passes freely through those portion of the tube of nominal oval cross section that have not been corrugated. However, wherever the tube has been corrugated according to the processing of FIGS. 4–10, the enlarged distal end of the mandrel engages the inner wall surface of tube 30 to expand the corrugations as it passes along them. Wherever corrugations in a tube pass through a collared hole in a fin, their expansion by distal end 70 of mandrel 68 forces them against the collar of the hole to thereby create a certain mechanical joining between tube and fin. That joining is sufficient to maintain the fin and tube in assembly relationship until they can be brazed together at a brazing operation that is subsequently performed. In its expanded corrugated cross sections, each tube has a flow area that is almost as large as those in its uncorrugated cross sections. FIGS. 17 and 18 illustrate withdrawal of mandrel 68 out of tube 30.

Figure 19:
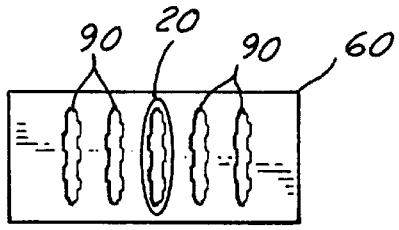
FIG. 19 is a cross section view in the direction of arrows 19—19 in FIG. 18.
Figure 20:
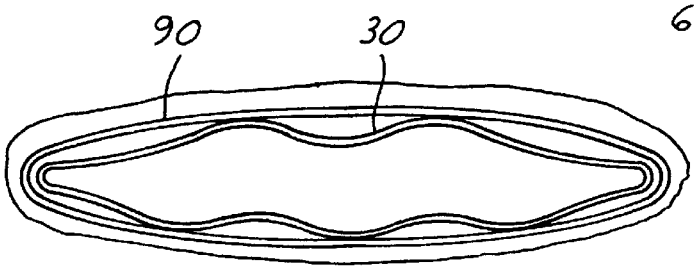
FIG. 20 is an enlarged view of a portion of a tube within the area marked 20 in FIG. 19

Wherever any tube 30 contains corrugations that have been created by the process of FIGS. 4–10 and those corrugations pass through a collared hole, the corrugations in the tube expand against the collared hole in the manner portrayed by FIGS. 19 and 20. Even if only the lower tube ends have been corrugated and they are expanded against the holes in only the lowermost fins in the stack, the resulting joints are sufficient to maintain all the fins and laced tubes in proper assembly relationship during handling of the core structure until the fins and tubes are brazed together at all collared holes through which the tubes pass as long as the core structure is maintained substantially upright. With the core structure upright, each higher fin in the stack continues to be supported on a lower one via the collars surrounding the holes in one of the two fins with the spacing distance established by the height of the collars.

If the tubes have also been corrugated where they pass through the uppermost fins in the stack, those corrugations too will be expanded against the holes in those uppermost fins, and intermediate fins that are between the uppermost and the lowermost fins will be captured in the stack regardless of the presence or absence of any corrugations in the tubes between the uppermost and lowermost fins to which the tubes have been staked. Of course, in the presence of such corrugations, the tubes will be staked to those intermediate fins, too.

While it is preferred that header plates 62, 64 be staked to the tubes as the fins are being staked, it should be appreciated that principles of the invention contemplate that one of both header plates can be assembled to a core structure in any suitable manner after the tubes have been staked to the fins in the manner described.

Although it was mentioned above that up to an entire length of a tube could be corrugated, it is preferred that the tube ends at which the mandrels enter not be corrugated. It is believed that leaving a short length of each tube free of corrugations at the end through which a mandrel enters facilitates mandrel entry into a tube by avoiding potential interference that might have an undesired effect on the outcome of the staking process.

Figure 21:
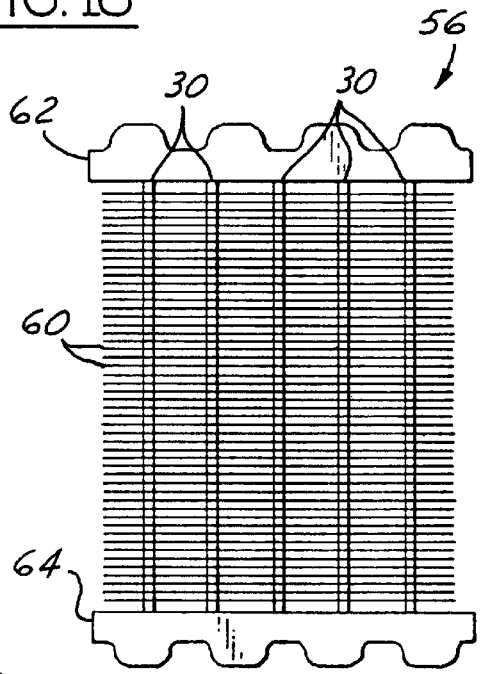
FIG. 21 is a front elevation view of core structure of a heat exchanger that has been fabricated using steps shows in previous Figures.

FIG. 21 illustrates finished heat exchanger core structure 56, including header plates 62, 64. In the finished heat exchanger, tanks (not shown) are assembled to top and bottom of the core structure, with tubes 30 opening at one end to the interior of one tank and at the opposite end to the interior of the other tank.

Figure 22:
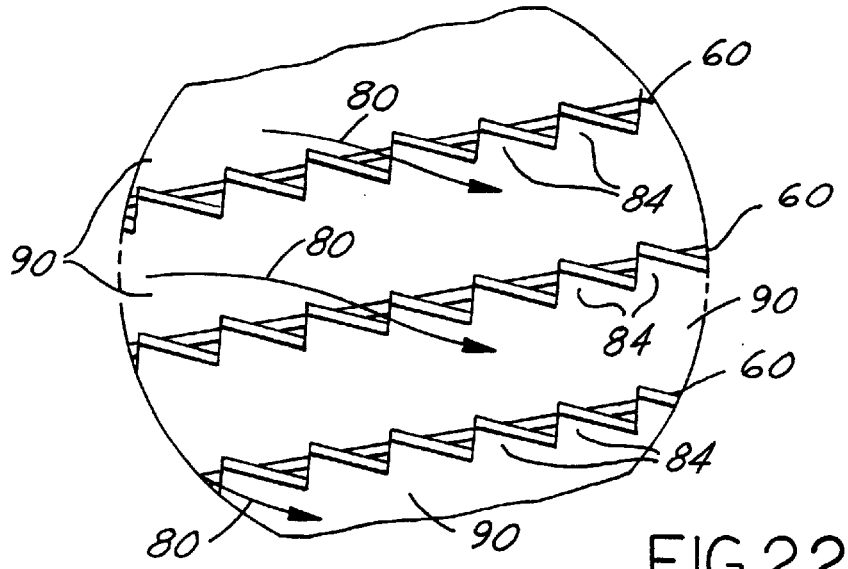
FIG. 22 is an enlarged fragmentary cross section view related to the core structure.
Figure 23:
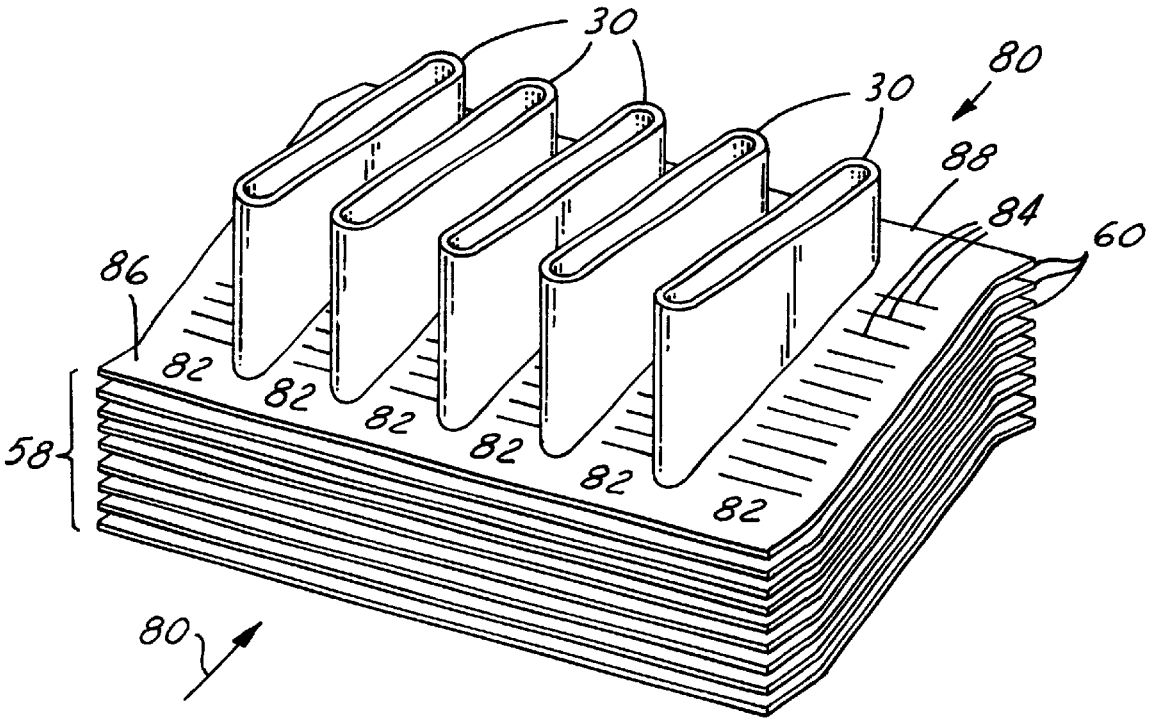
FIG. 23 is a fragmentary perspective view related to the core structure.

In a representative use of a heat exchanger that comprises core 56, liquid flows from one tank through tubes to the other tank while gas flows through stack 58 in the manner suggested by arrow 80 in FIGS. 18, 22, and 23. FIGS. 22 and 23 show a representative embodiment of gosper fins like one of those in the above-referenced patent. Each fin comprises identical spaced apart rows 82 of louvered slots 84. The inner rows 82 are between adjacent tubes 30 while the two outer rows are outboard of the two outboard tubes 30. Upstream and downstream margins 86, 88 of fins 58 are essentially parallel to the incident gas flow entering the core of the heat exchanger. The more expansive intermediate area of each fin between its margins 86, 88 is inclined to the incident flow, and it is in that area of each fin that the louvered slots 84 are disposed. As suggested by the arrows in FIG. 22, the gas can flow through the louver slots thus passing across surfaces of multiple fins as it wends its way through the core. FIG. 22 shows collars 90 forming the collared holes in the fins through which the tubes pass and which set the spacing distance between fins in the stack.

Figure 24:
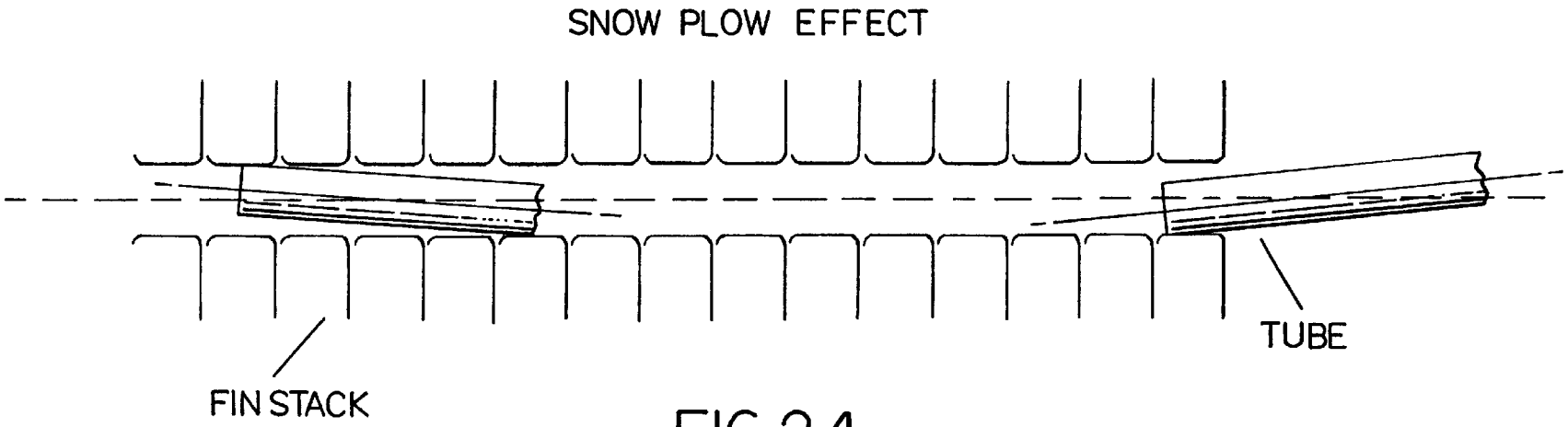
FIGS. 24 and 25 are somewhat diagrammatic views useful in illustrating certain benefits of the present invention.
Figure 25:
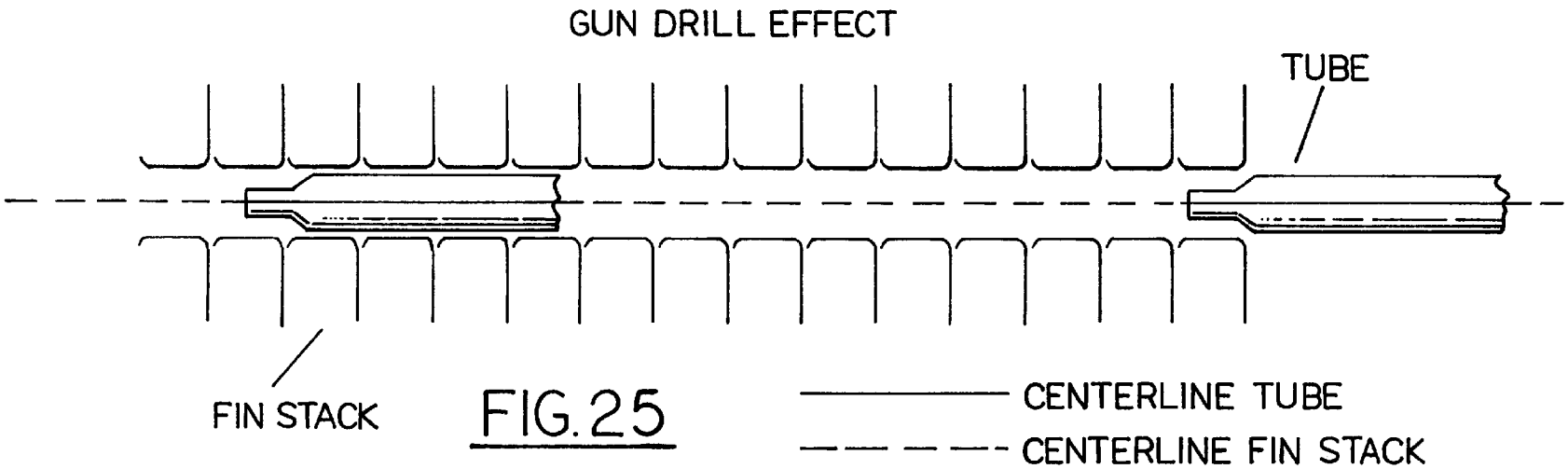

FIGS. 24 and 25 illustrate the benefit of fabricating a heat exchanger using tubes 30 processed by the process of FIGS. 4–10. Because the lead end of a tube has a smaller cross section, while an immediately following portion of the tube length has a larger one, the lacing of a tube through the stack is analogous to gun drilling, portrayed by FIG. 25. A tube 30 is kept straight as it passes through aligned holes in the stack, and does not experience a snow plow effect, as portrayed by FIG. 24, where a tube like the one in FIGS. 1–3 is not kept straight and is hence prone to snagging.

Aluminum is typically used for both fins and tubes, and it is a preferred material in the practice of the present invention. While the foregoing description has referred to the tubes and holes as having specific oval shapes, as in FIG. 4 for example, it is to be appreciated that reference to an oval shape means any generally oblong, flattened shape. A specific example of a tube that is suitable for use in the practice of the invention is 3003 or 3005 aluminum having an oval cross section like that in FIG. 4 with a width W of about 2.08 millimeters, a length of about 25.97 millimeters, and a nominal wall thickness of about 0.33 millimeters.

While a presently preferred embodiment has been illustrated and described, it is to be appreciated that the invention may be practiced in various forms within the scope of the following claims.

What is claimed is:

1. A method of making a heat exchanger core that comprises a stack of fins having sets of aligned holes through which tubes are laced, the method comprising:

corrugating at least portions of the lengths of the tubes by forcing diametrically opposed wall sections of each tube toward each other and forming corrugations in those wall sections such that the corrugations in each wall section of a tube are in a nesting relationship to those in the opposed wall section of that tube;

lacing each tube through a respective set of aligned holes in the fins; and then expanding the cross sections of the corrugated portions of the tubes at the opposed wall sections of each tube.

2. The method as set forth in claim 1 in which the corrugating step comprises corrugating leading lengthwise end portions of the tubes by forcing diametrically opposed wall sections of the leading lengthwise end portion of each tube toward each other and forming corrugations in those wall sections such that the corrugations in each wall section of a tube are in a nesting relationship to those in the opposed wall section of that tube, the lacing step comprises lacing each of the tubes, via its corrugated leading lengthwise end portion, through a respective set of aligned holes in the fins to dispose each corrugated leading lengthwise end portion in a hole in at least one fin, and the expanding step comprises expanding the cross section of each corrugated leading lengthwise end portion at the opposed wall sections against the hole in the at least one fin through which the respective tube passes to thereby stake each tube to the at least one fin.

3. The method as set forth in claim 2 including the step of disposing at an end of the stack of fins, a header plate containing holes through which the corrugated leading lengthwise end portions of the tubes pass, and in which the expanding step also comprises expanding the cross sections of the corrugated leading lengthwise end portions of the tubes at their opposed wall sections against the holes in the header plate to thereby also stake the tubes to the header plate.

4. The method as set forth in claim 2 including the further step of metallurgically bonding the tubes to the fins throughout the stack after the expanding step.

5. The method as set forth in claim 4 in which the step of metallurgically bonding the tubes to the fins throughout the stack after the expanding step comprises brazing the tubes and fins together.

6. The method as set forth in claim 1 in which the corrugating step includes corrugating portions of the tubes passing through holes in lowermost and uppermost fins in the stack by forcing diametrically opposed wall sections of those portions of each tube toward each other and forming corrugations in those wall sections of each tube such that the corrugations in each wall section of each tube are in a nesting relationship to those in the opposed wall section, and the expanding step includes expanding the cross sections of the corrugated portions of the tubes at their opposed wall sections against the holes in the lowermost and uppermost fins in the stack to thereby stake the tubes to the lowermost and uppermost fins in the stack.

7. The method as set forth in claim 1 in which the expanding step comprises running mandrels through the tubes against corrugations of the corrugated portions.

8. The method as set forth in claim 1 in which each tube comprises a nominally oval cross section having a width and a thickness, the corrugating step comprises corrugating a widthwise intermediate portion of the tube that, in the tube cross section, is intermediate opposite widthwise end portions, and the expanding step comprises expanding the widthwise intermediate portion in the direction of the cross section thickness.

9. A method of making a heat exchanger core that comprises a stack of fins having sets of aligned oval holes through which tubes of oval cross section are laced, wherein the oval cross section of the tube comprises nominal width and thickness having substantially flat, substantially parallel, sides that are spaced apart in the direction of the nominal thickness and that are joined by rounded ends in the direction of nominal width, the method comprising:

corrugating the substantially flat, substantially parallel, sides of the tubes along at least portions of the lengths of the tubes by forming corrugations in those sides such that the corrugations in each side of a tube are in a nesting relationship to those in the opposite side and lacing each tube through a respective set of aligned holes in the fins; and then expanding the cross sections of the tubes containing the corrugated sides to force the corrugations in each side of each tube away from those in the opposite side of that tube.

10. The method as set forth in claim 9 in which the expanding step comprises running mandrels through the tubes against corrugations of the corrugated sides.

11. A method of making a heat exchanger core that comprises a stack of fins having at least one set of aligned holes through which a respective nominally oval tube is laced, the method comprising:

for each set of aligned holes, providing a respective tube that has an oval cross section of nominal width and thickness and a corrugated lengthwise leading end portion that has a transverse cross section of overall width and thickness slightly less than the nominal width and thickness of the oval cross section, wherein each corrugated lengthwise leading end portion comprises opposite wall sections, each of which has corrugations in nesting relationship to those of the opposite wall section; and lacing each tube through the respective set of holes by inserting the leading lengthwise end portion into a first hole of the respective set that is in a first of the fins in the stack and then through successive holes of the respective set that are in successive fins in the stack.

12. A method as set forth in claim 11 including the step of expanding the corrugated leading lengthwise end portion of each tube after the lacing step to force the corrugations in each wall section of each tube away from those in the opposite wall section.

13. A method as set forth in claim 12 in which the expanding step includes expanding the corrugated leading lengthwise end portion of each tube against a hole in at least one fin of the stack after the respective tube has been laced through the stack to thereby stake the respective tube to at least one fin of the stack via the corrugations of the respective tube.

14. A method as set forth in claim 13 including the step of metallurgically joining the tubes to the fins at the holes.

15. A method of making a heat exchanger core that comprises a stack of fins having at least one set of aligned holes through which a respective nominally oval tube is laced, the method comprising:

for each set of aligned holes, providing a respective tube that comprises an oval cross section of nominal width and thickness having substantially flat, substantially parallel, sides that are spaced apart in the direction of the nominal thickness and that are joined by rounded ends in the direction of nominal width and that comprises a lengthwise leading end portion that comprises a transverse cross section of overall width and thickness slightly less than the nominal width and thickness of the oval cross section and that comprises corrugated sides continuing lengthwise of the tube from the substantially flat, substantially parallel, sides of the oval cross section of nominal width and thickness, wherein each corrugated side has corrugations in nesting relationship to those of the side; and lacing each tube through the respective set of holes by inserting the corrugated leading lengthwise end portion into a first hole of the respective set that is in a first of the fins in the stack and then through successive holes of the respective set that are in successive fins in the stack.

16. A method as set forth in claim 15 including the step of expanding the corrugated leading lengthwise end portion of each tube in the direction of tube cross section thickness after the respective tube has been laced through the stack to thereby stake the respective tube to at least one fin of the stack via the corrugations of the respective tube.

* * * * *